US009029797B2

(12) United States Patent
Denning et al.

(10) Patent No.: US 9,029,797 B2
(45) Date of Patent: May 12, 2015

(54) PLASMA-BASED PHOTON SOURCE, ION SOURCE, AND RELATED SYSTEMS AND METHODS

(71) Applicant: Agilent Technologies, Inc., Loveland, CO (US)

(72) Inventors: Mark Denning, Loveland, CO (US); Guthrie Partridge, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 13/951,301

(22) Filed: Jul. 25, 2013

(65) Prior Publication Data

US 2015/0028222 A1 Jan. 29, 2015

(51) Int. Cl.

| | |
|---|---|
| ***H01J 49/00*** | (2006.01) |
| ***H01J 27/24*** | (2006.01) |
| ***H01J 49/16*** | (2006.01) |

(52) U.S. Cl.

CPC ..... *H01J 27/24* (2013.01); *H01J 49/162* (2013.01)

(58) Field of Classification Search

CPC ..... H01J 49/00–49/406
USPC ..... 250/424
See application file for complete search history.

(56) References Cited

U.S. PATENT DOCUMENTS

| | | | | |
|---|---|---|---|---|
| 5,086,254 | A | 2/1992 | Wells | |
| 7,091,481 | B2 * | 8/2006 | Miller et al. | 250/288 |
| 7,569,812 | B1 * | 8/2009 | Karpetsky et al. | 250/282 |
| 8,217,343 | B2 | 7/2012 | Cooley et al. | |
| 8,653,491 | B2 * | 2/2014 | Partlo et al. | 250/504 R |
| 2007/0023705 | A1 * | 2/2007 | Partlo et al. | 250/504 R |
| 2013/0001416 | A1 | 1/2013 | Cooley et al. | |

OTHER PUBLICATIONS

A. Piel, "Plasma Physics", chapter 2, Springer-Verlag 2010.*
Hidaka, T.; Extremely Low-Loss Hollow Core Waveguide for VUV Light; Optics Communications; vol. 44, No. 2; Dec. 15, 1982; pp. 90-93.
Tonkyn, et al.; Compact Vacuum Ultraviolet Source for Photoelectron Spectroscopy; Rev. Sci. Instrum. 60 (7), Jul. 1989; pp. 1245-1251.

* cited by examiner

*Primary Examiner* — Phillip A Johnston

(57) ABSTRACT

A photon source includes a plasma source for generating plasma and a photon guide through which the plasma travels. The photon guide includes an inner surface configured for reflecting photons emitted from the plasma. As the plasma travels through the photon guide, plasma electrons and ions recombine at the inner surface, whereby the predominant species emitted from an outlet of the photon guide are the photons and neutral particles, with few or no plasma electrons and ions being emitted.

18 Claims, 7 Drawing Sheets

PLASMA-BASED PHOTON SOURCE, ION SOURCE, AND RELATED SYSTEMS AND METHODS

TECHNICAL FIELD

The present invention relates generally to plasma-based photon sources, which may be utilized, for example, for irradiation of samples. Irradiation may be carried out for non-ionizing purposes or to cause photo-ionization of molecules. Photo-ionization may be implemented, for example, in conjunction with analytical techniques such as spectrometry. One aspect of the invention relates to supplying photons emitted from plasma while suppressing the flux of other plasma species.

BACKGROUND

Many applications involve the use of a photon source (or light source) to produce electromagnetic radiation at specific wavelengths or wavelength ranges, e.g., in the ultraviolet (UV), visible, or infrared (IR) range. For example, an analytical instrument may utilize photons to perform optical-based measurements on a sample (e.g., absorbance, reflectance, transmittance, luminescence, light scattering, fluorescence, phosphorescence, etc.), or to form analyte ions from a sample by photo-ionization in preparation for spectrometric analysis (e.g., mass spectrometry or MS, ion mobility spectrometry or IMS).

A spectrometry system in general includes an ionization apparatus (or ion source) for ionizing components of a sample of interest, an analyzer for separating the ions based on a discriminating attribute, an ion detector for counting the separated ions, and electronics for processing output signals from the ion detector as needed to produce user-interpretable spectral information. The spectral information may be utilized to determine the molecular structures of components of the sample, thereby enabling the sample to be qualitatively and quantitatively characterized. In an MS system, the analyzer is a mass analyzer that separates the ions based on their differing mass-to-charge ratios (or m/z ratios, or more simply "masses"). Depending on design, the mass analyzer may separate ions by utilizing electric and/or magnetic fields, or time-of-flight tubes. In an IMS system, the analyzer is a drift cell that separates ions based on their different collision cross-sections. Ions are pulled through the drift cell by a DC voltage gradient in the presence of a drift gas. Ions of differing cross-sectional areas have differing mobilities through the gas environment. An IMS may be coupled with an MS to provide unique two-dimensional information about an analyte under investigation. Additionally, in certain "hyphenated" or "hybrid" systems the sample supplied to the ionization apparatus may first be subjected to a form of analytical separation. For example, in a liquid chromatography-mass spectrometry (LC-MS) system or a gas chromatography-mass spectrometry (GC-MS) system, the output of the LC or GC column may be transferred into the ionization apparatus through appropriate interface hardware.

An electron ionization (EI) source is commonly deployed as the ionization apparatus in MS. The EI source utilizes a high-energy (70 eV) beam of electrons to break analyte molecules into a range of ionized fragments, which are then utilized to produce a mass spectrum. While the EI technique is well suited for targeted analysis in which a measured mass spectrum is compared against spectral libraries, it is poorly suited to analysis of unknown compounds. For analysis of unknown compounds it is desirable to produce either molecular ions (in which the analyte is left intact with only a single electron removed) or a limited number of high-mass fragments. This can be achieved by "soft ionization" in which the energy of the particles used for analyte ionization is high enough to ionize but too low to cause significant fragmentation (e.g., 8-12 eV). While low-energy electron beams may be utilized to achieve this, their current is space-charge limited and their energy spectrum relatively wide (several eV). Soft ionization may also be implemented by chemical ionization (CI), which utilizes an electron beam or corona discharge in conjunction with an added reagent compound such as methane, adding cost and complexity to the instrument.

An alternative to EI and CI is photo-ionization (PI) in which ionization results from irradiation of the sample by ultraviolet (UV) photons. Ultraviolet PI is becoming recognized for its ability to ionize many chemical species, both polar and non-polar, with reduced fragmentation and with retention of high sensitivity and dynamic range as compared to other ionization techniques. With the appropriate choice of photon wavelength (energy), efficient analyte ionization and low levels of undesired ionization of non-analytical components such as solvents can be achieved simultaneously. The UV photons are typically produced by a plasma source. As there is no space charge limitation for photonic radiation, the flux of UV photons is limited only by how strong of a flux can be produced by a plasma source. Additionally, UV emission spectra are typically extremely narrow (e.g., much less than 1 eV).

To confine and isolate the UV-emitting plasma away from the photo-ionization region, the plasma source often employs a window that is transparent to UV, which may have a composition such as magnesium fluoride ($MgF_2$), calcium fluoride ($CaF_2$), or lithium fluoride (LiF). However, materials with good transmission in this spectral range have a tendency to degrade as a result of UV transmission and thus have limited operating lifetimes. Additionally there are some UV energies for which no suitably transparent materials exist. Moreover, windows of any type present solid surfaces and thus are prone to coating by analytes or contaminants, further impairing UV transmission and requiring cleaning. To avoid these problems, windowless plasma UV sources may be employed. Lacking a window, plasma particles are free to stream out into the ionization region. This plasma plume can have a negative effect on the ion source operation. High energy species (including ions, electrons, and excited metastable atoms) can cause unwanted fragmentation, and significant amounts of plasma ions can appear in the mass spectra. The UV light emitted by such devices is not collimated, and transmissive optics for light at these wavelengths exhibit the same limitations as those described for windows. Consequently, it is advantageous to locate the source of UV photons as close as possible to analyte molecules. This proximity however also increases the undesirable plasma flux that enters the photo-ionization region.

The challenge then is to deliver UV to the ionization region while simultaneously limiting both plasma interaction with analyte molecules and plasma ion contamination of the mass spectrum. One known approach is to place electrostatic optics between the plasma source and the ionization region. The optics are then biased such that the plasma ions and electrons are deflected away from the ionization region. This approach is limited by the propensity for DC plasma discharges to form outside of the confining structure of the plasma source when biased surfaces are nearby, exacerbating the issue of plasma interaction/contamination. Also, plasmas exhibit a property in which electric fields are shielded, which limits the effectiveness of electrostatic optics. These optics can also shadow UV emission, reducing the amount of UV photons delivered into the ionization region.

Therefore, there is a need for photon sources and PI sources capable of producing high photon flux levels while minimizing or eliminating the problems noted above.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a photon source includes: a plasma source including a housing enclosing a source interior and a plasma outlet communicating with the source interior; and a photon guide including an inlet end communicating with the plasma outlet for receiving plasma including photons generated thereby, an outlet end, and a wall having a length along a guide axis and enclosing a guide interior, wherein the wall includes an inner surface configured for reflecting the photons.

According to another embodiment, a photo-ionization (PI) apparatus includes: a photon source as disclosed herein; and a sample conduit positioned to direct a flow of sample material into a path of the photons.

According to another embodiment, an analytical system includes: a PI apparatus as disclosed herein; and an analytical instrument communicating with the outlet end.

According to another embodiment, a method for supplying photons includes: generating plasma in a plasma source; and forming a reduced-density plasma by flowing the plasma from the plasma source through a hollow photon guide including an inner surface configured for reflecting photons of the plasma, wherein ions and electrons of the plasma recombine at the inner surface while the photons are reflected from the inner surface; and directing the photons of the reduced-density plasma toward an outlet end of the photon guide.

According to another embodiment, a method for ionizing a sample includes: supplying photons as disclosed herein to an ionization region; and introducing the sample into the ionization region.

According to another embodiment, a method for analyzing a sample includes: ionizing the sample as disclosed herein to form analyte ions; and measuring an attribute of the analyte ions.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

In the context of the present disclosure, "plasma" ions are ions formed by generating and thereafter sustaining plasma from a plasma-forming background or working gas (argon, helium, etc.). Plasma ions are distinguished from "analyte" or "sample" ions, which are ions formed by photo-ionization (PI) of sample molecules. PI entails irradiation of the sample molecules by the photons emitted (generated) from the plasma due to relaxation of electronically excited plasma species. Accordingly, analyte ions are the ions of interest in a given analytical procedure, as opposed to plasma ions. In the context of an analytical procedure such as spectrometry, plasma ions are an unavoidable component of the plasma that may affect the PI process and contribute to the ion signal in an undesirable manner.

Figure 1:
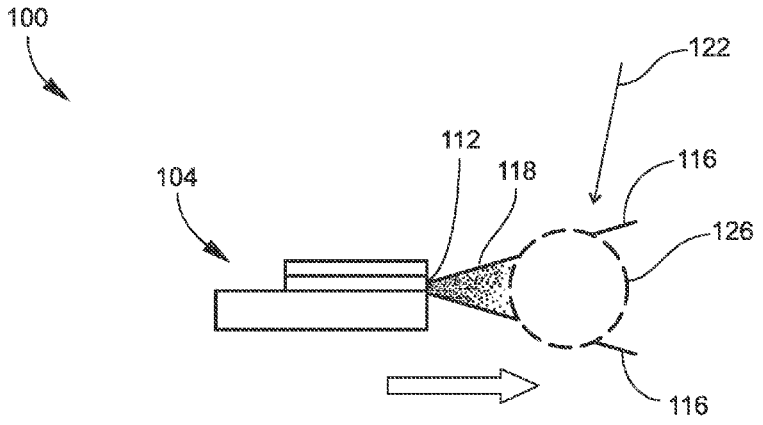
(PRIOR ART) Fig. 1
FIG. 1 is a schematic view of a known photon source.

FIG. 1 is a schematic view of a known photon source 100. The photon source 100 generally includes a plasma source 104 configured for generating plasma. The plasma source 104 includes a plasma outlet 112 through which photons 116 and a plasma plume 118 are emitted. The plasma plume 118 is shown as having a diverging or diffusive spatial orientation, as the plasma plume 118 is not constrained by any structural boundaries in the immediate vicinity of the plasma outlet 112. The photons 116 also tend to propagate in a diverging manner as they are not collimated by any particular means.

FIG. 1 illustrates the photon source 100 being utilized for photo-ionization of sample molecules, such as may be part of an ion source provided at the front end of a mass spectrometer, ion mobility drift tube, etc. In this context, the plasma is generated for the purpose of producing photons and is typically outputted from the plasma outlet 112 into a chamber (not shown). Sample material to be ionized is directed (arrow 122) into the plasma plume 118 for interaction with the photons, as generally represented by an ionization region 126 in FIG. 1. In this known configuration, the plasma outlet 112 may be small relative to the dimensions of the source interior, thereby acting as a conductance limit that hinders the flow of gas molecules through the plasma outlet 112. However, the plasma plume 118 reaching the ionization region 126 nonetheless may have a relatively high density of all types of plasma species. As appreciated by persons skilled in the art, the plasma species include, in addition to photons, plasma ions, plasma electrons, metastable atoms, and neutral gas molecules. Thus, in the known configuration the sample material in the ionization region 126 may be exposed not only to the photons but also to all other types of energetic species of the plasma. Hence, the known configuration is associated with the problems discussed above, including contamination by plasma ions and excessively hard ionization or unwanted fragmentation.

Figure 2:
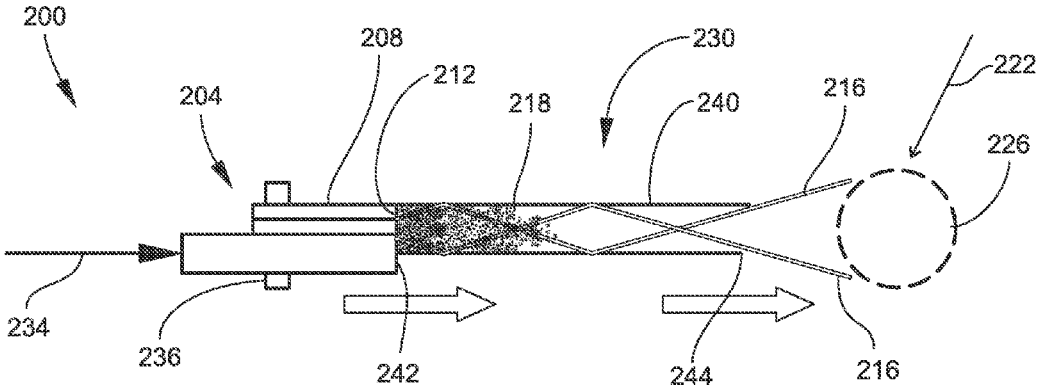
FIG. 2 is a schematic view of an example of a photon source according to some embodiments of the present disclosure.
Figure 2:
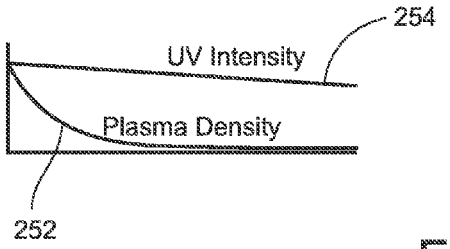

FIG. 2 is a schematic view of an example of a photon source 200 according to some embodiments of the present disclosure. The photon source 200 generally includes a plasma source 204 and a photon guide 230. The plasma source 204 generally includes a housing 208 enclosing a plasma source interior, a gas inlet 234 for introducing a plasma-forming gas into the source interior, and an energy source 236 configured for generating the plasma from the plasma-forming gas. The housing 208 includes a plasma outlet 212 through which a plasma plume or cloud 218 is emitted from the source interior. The flow of plasma through the plasma outlet 212 may be driven by various means, such as a pressure differential between the source interior and the environment outside the source interior. The plasma may be generated by various known techniques. The plasma is typically driven by electrical or microwave power. As examples, the energy source 236 may include electrodes coupled to a direct current (DC), alternating current (AC) or radio frequency (RF) voltage source, and may further include one or more dielectric barriers, resonant cavities, and/or magnets. Accordingly the plasma may be, for example, a DC plasma, AC plasma, RF plasma, glow discharge, corona discharge, dielectric barrier discharge (DBD), or microwave-induced plasma (MIP). The plasma-forming gas may be, for example, a noble gas (helium, neon, argon, krypton, or xenon), a combination of two or more noble gases, or a combination of a non-noble gas (e.g., hydrogen, or a halogen such as fluorine, chlorine or bromine) with one or more noble gases. The plasma-forming gas may be selected based on the type (wavelength of propagation) of photons sought to be emitted from the plasma. The photons may be ultraviolet (UV) photons, including vacuum ultraviolet (VUV) photons (wavelengths of 200 nm or lower), or visible (Vis) photons, or infrared (IR) photons. The mechanism for generating the plasma may be based on resonant coupling of energy or formation of excimers. Generally the various types of plasmas, and the design and operating principles of various types of energy sources utilized to generate plasmas, are generally known to persons skilled in the art and thus for purposes of the present disclosure need not be described further.

It will be noted that no specific limitation is placed on the size of the photon source 200. The size generally depends on the application. By example only, FIG. 2 schematically depicts the plasma source 204 in the form of a microplasma chip configured for producing a microplasma (small-scale plasma), which may be fabricated by known microfabrication techniques using suitable materials.

The photon guide 230 includes one or more walls 240 that enclose a photon guide interior or volume such that the photon guide 230 is hollow. The wall 240 (or walls) define a guide inlet or inlet end 242 facing the plasma outlet 212, and an axially opposite guide outlet or outlet end 244. The wall 240 may define a cylinder, but more generally may have any rounded or polygonal geometry. The wall 240 has a length along a longitudinal axis, or photon guide axis. The axial length of the photon guide 230 may be the dominant dimension, such that the photon guide 230 may be characterized as being elongated along the longitudinal or photon guide axis. The axial length of the photon guide 230 may in some embodiments be only as great as necessary for adequately suppressing plasma flux, as described further below. While in the illustrated embodiment the photon guide 230 is straight, in other embodiments all or part of the photon guide 230 may be curved. As illustrated in FIG. 2, the diameter of the photon guide 230 may be greater than the diameter of the plasma outlet 212 to allow all photons emitted through the plasma outlet 212 to enter the photon guide 230 while simultaneously allowing the plasma plume to expand outward onto the inner surface or surfaces of the photon guide 230. In the present context, the term "diameter" is used generically to describe any characteristic dimension of the photon guide 230, which is dependent on the cross-sectional geometry of the photon guide 230. That is, the characteristic dimension of the photon guide 230 may be a diameter in the case of a circular cross-section, a major axis in the case of an elliptical cross-section, or a length/width of a side in the case of a polygonal cross-section.

The photon guide 230 includes an inner surface (or surfaces) that are internally reflective to the photons of the plasma. The inner surface may be the inner surface of the wall 240 of the photon guide, or may be a layer (e.g., coating or film) disposed on the inner surface of the wall 240. The wall 240 (or inner surface thereof) may be configured to reflect photons by any suitable mechanism including, for example, total internal reflection (TIR), "ordinary" or "mirror" reflection, or both of these mechanisms.

Accordingly, in some embodiments the composition of the photon guide 230 (or a layer on its inner surface) may be selected so as to have a refractive index relative to that of the guide interior such that all or most of the photons are internally reflected by TIR. As appreciated by persons skilled in the art, when a light ray passes a planar boundary between a first medium of higher index of refraction ($n_1$) to a second medium of lower index of refraction ($n_2$), i.e. $n_1>n_2$, there is a critical angle of incidence (measured between the direction of light propagation and the direction normal to the boundary) beyond which all of the light is reflected back into the first medium. At the wavelength range of light relevant to the present disclosure, many materials exhibit an index of refraction less than unity ($n<1$). Examples include most metals and dielectrics, notably glass (see, e.g., Hidaka, T., "Extremely low-loss hollow core waveguide for VUV light," Optics Communications, Vol. 44, pp. 90-93 (1982)). A hollow core light guide constructed of such a material propagates the relevant light by repeated total internal reflections according to the same principle of operation as an optical fiber). Such a waveguide only accepts and propagates incident light having a propagation angle less than the critical angle $\theta_c$, but once coupled, such light may propagate over relatively long distances (e.g., meters or kilometers).

In other embodiments, the composition of the photon guide 230 (or a layer on its inner surface) may be selected so as to reflect photons by way of "ordinary" or "mirror" reflection. This type of reflection may be based on the "reflectance" property of the material, which may in part depend on the thickness of the material. In this case, the material acts as a mirror for photons of the relevant wavelength or wavelength range over some range of angles of incidence. The material may act as a mirror in the sense that the material reflects all or most of such photons instead of absorbing or transmitting the photons, and the reflection is not necessarily based on the difference in refractive indices at the boundary as in the case of TIR. Examples include various metals, oxides and nitrides.

In some embodiments, the composition of the photon guide 230 (or a layer on its inner surface) may be such as to exhibit reflection both by TIR and by mirror reflection to varying degrees for the photons of interest. In this case, a particular material for the photon guide 230 (or layer) may be selected for its predominant mechanism of reflection (TIR or mirror reflection), while the other mechanism serves an ancillary role.

In all such cases, the effect of the photon guide 230 is to suppress the plasma flux as the plasma plume 218 travels from the inlet end 242 to the outlet end 244, while transmitting the photons 216 to the outlet end 244 with minimal loss. That is, the photon guide 230 reduces the density or concentration of all plasma species other than the photons 216 and unexcited neutral species. As plasma travels through the photon guide 230, plasma ions and plasma electrons diffuse outwardly and recombine at the inner surface. Also, metastable atoms diffuse outwardly and become de-excited upon impact with the inner surface. Meanwhile, the population of photons 216 propagating through the photon guide 230 is preserved or substantially preserved via internal reflection as described above. Consequently, the ensemble of components reaching and exiting the outlet end 244 consists primarily of photons 216 and neutral gas atoms or molecules. The reduction in plasma density and propagation of photons through the photon guide 230 is shown schematically in FIG. 2, as well as graphically in plots below the photon guide 230. In these plots, the horizontal axis represents distance along the photon guide 230 and the vertical axis represents plasma density (arbitrary units) and photon intensity (arbitrary units) as a function of distance. As shown, the plasma density (curve 252) drops rapidly and significantly such that very few plasma ions and plasma electrons (and a reduced number of metastables) reach the outlet end 244. By contrast, the photon population (curve 254) is largely maintained with only a slight loss occurring along the length due to absorption by or transmission through the material of the photon guide 230 and/or resonant absorption by plasma gas atoms.

FIG. 2 further illustrates the photon source 200 being utilized for photo-ionization of sample molecules directed (arrow 222) to an ionization region 226 outside the outlet end 244 of the photon guide 230. As schematically shown, at the ionization region 226 the sample material interacts only (or substantially only) with photons 216 and not with other energetic plasma species.

The photon source 200 thus may provide a number of advantages. By significantly reducing the concentration of energetic plasma species (other than photons), the photon guide 230 isolates or decouples the sample analytes and ionization region 226 from the plasma species. At the same time, the photon guide 230 collects and transmits a very high fraction of the photons generated in the plasma source 204, limited only by the reflectivity of the inner surface of the photon guide 230 for the photon wavelengths of interest. In addition, the photon source 200 provides a passive solution to reducing plasma flux, and thus may eliminate the need for actively biased electrodes or electrostatic optics placed between the plasma and ionization region 226, thereby eliminating the problems associated with such optics such as shadowing of photon transmission, electrical discharges, and formation of secondary plasma, which enhance the opportunity for unwanted fragmentation of analyte ions and contamination of mass spectra by plasma ions. As a corollary, the significant reduction in plasma density may eliminate the risk of electrical discharges caused by operating ion collection optics positioned nearby the ionization region 226. As appreciated by persons skilled in the art, such ion collection optics may utilized in an ionization chamber to focus and transmit a beam of analyte ions formed by the photo-ionization process to downstream ion processing devices (e.g., ion guides, collision cells, mass analyzers, detectors, etc.). The photon source 200 may allow higher voltages to be applied to such ion collection optics without concern for causing electrical discharges. In addition, the photon guide 230 may be useful for maintaining a large pressure differential between the plasma source 204 and a chamber in which the ionization region 226 is confined. In many embodiments, operation of the plasma source 204 is optimized at around 1 Torr while the photo-ionization process (on the opposite end of the photon guide 230) may be implemented at vacuum conditions. The photon guide 230 presents a gas conductance barrier in addition to that presented by the plasma outlet 212, which may further result in reduced plasma flow rates. Thus, it is evident the photon source 200 may operate as an effective windowless source that avoids problems inherent in windowed sources, such as limited photon transmission and damage to and fouling of the windows utilized in windowed sources.

Figure 3:
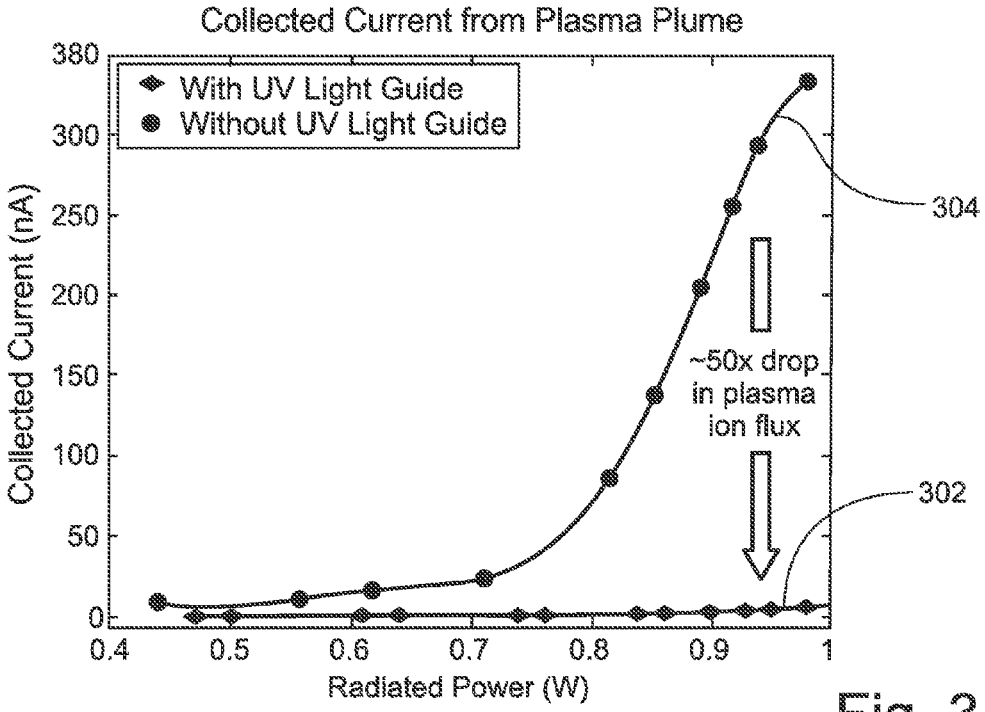
FIG. 3 is a plot of measured current (nA) drawn from a plasma plume as a function of radiated microwave power (W) acquired from testing a photon source having a configuration consistent with that described above and illustrated in FIG. 2.
Figure 4:
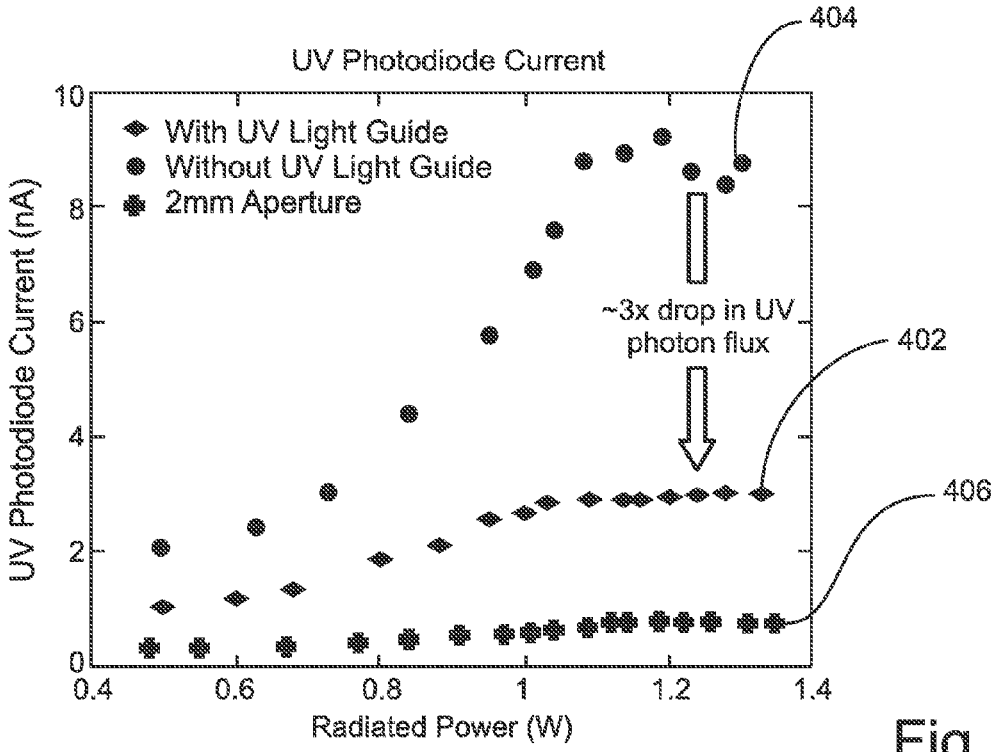
FIG. 4 is a plot of measured UV-induced photodiode current (nA) as a function of radiated microwave power (W) acquired from testing the photon source.

FIGS. 3 and 4 present data acquired from testing a photon source having a configuration consistent with that described above and illustrated in FIG. 2. The plasma source was structured as a microplasma chip. The photon guide was a fused silica tube having a length of 18 mm and inside diameter of 2 mm. The photon guide exhibited internal reflection of UV photons. The UV photons were produced from microwave-induced plasma formed from a gas composed of 10% krypton/90% helium. The flow rate of the plasma gas was 4 sccm (standard cubic centimeters per minute) producing a pressure of approximately 1 Torr in the plasma formation region. FIG. 3 is a plot of electrical current (nA) collected from the plasma plume by planar electrodes biased at 5 V as a function of radiated microwave power (W). The electrodes were alternately positioned at the exit of the photon guide (curve 302) and at the exit of the microplasma chip without the photon guide (curve 304). It is seen that including the photon guide in this test resulted in about a fifty-times (50×) drop in plasma ion flux as compared to not including the photon guide. FIG. 4 is a plot of measured UV-induced photodiode current (nA) as a function of radiated microwave power (W) with the photon guide (curve 402) and without the photon guide (curve 404). FIG. 4 also shows a plot of photodiode current (curve 406) without the photon guide but with a 2-mm aperture positioned 18 mm away from the microplasma chip (matching the inner diameter and length of the photon guide). The purpose of this was to mimic the case for which all photons incident on the inner walls of a photon guide were absorbed. The distance of the 1 cm×1 cm photodiode from the microplasma chip is the same in all cases. It is seen that including the photon guide resulted in about a three-times (3×) drop in UV photon flux as compared to not including the photon guide. The far greater drop in plasma flux (FIG. 3) in comparison to the drop in UV photon flux (FIG. 4) demonstrates the dual functions of plasma suppression and photon guiding achieved by the photon guide.

Referring back to the embodiment of FIG. 2, the inlet end 242 of the photon guide 230 abuts the housing 208 of the plasma source 204 such that the inlet end 242 forms a closed boundary around the plasma outlet 212. Accordingly, all components exiting the plasma source 204 enter the photon guide 230. In some embodiments, the inlet end 242 may be coupled to the housing 208 in a sealed (gas-tight) manner by any suitable means such as, for example, bonding or adhesion. In some embodiments, a sealing component (not shown) may be added to the interface between the inlet end 242 and the housing 208 to provide or enhance a gas-tight seal such as, for example, an adhesive, a gasket, etc. In other embodiments, the inlet end 242 may be spaced from the housing 208 by a small gap while still being aligned with the plasma outlet 212 along the guide axis.

Figure 5:
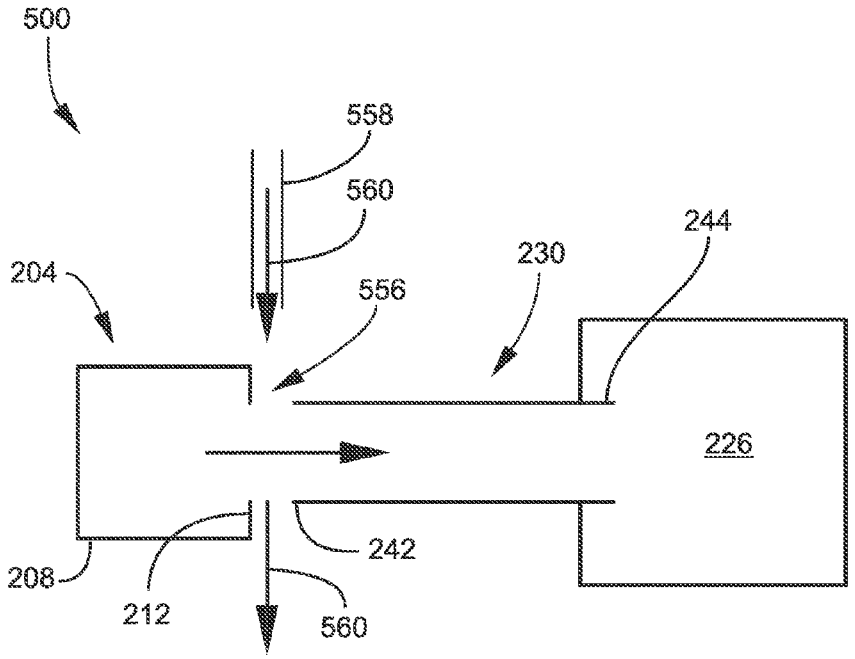
FIG. 5 is a schematic view of an example of a photon source according to an embodiment in which a plasma source and a photon guide are separated by a gap.

FIG. 5 is a schematic view of an example of a photon source 500 according to an embodiment in which a gap 556 is provided. As the envelope of the photon propagation from the plasma outlet 212 is divergent, the inside diameter of the photon guide 230 of the embodiment shown in FIG. 5 may be larger relative to that of the embodiment shown in FIG. 2 to ensure efficient collection of the photons. The gap 556 may be useful for dispersing unwanted plasma species and neutral gas molecules such that they do not enter the photon guide 230, thus supplementing the desirable process of reducing the plasma density. In some embodiments, this process may be further enhanced by providing a sweep gas inlet or conduit 558 positioned to direct a sweep gas 560 into and through the gap 556 at an angle to the guide axis. In the illustrated embodiment, the angle is ninety degrees although any angle that provides a path for the sweep gas 560 through the gap 556 and intersects the path of the output of the plasma outlet 212 may be sufficient. The flow of sweep gas 560 through the gap 556 may be characterized as a gas curtain or gas knife. The sweep gas 560 may be useful for carrying or diverting unwanted plasma species and neutral gas molecules away from the inlet end 242. The sweep gas 560 may be any inert gas such as, for example, helium, argon, nitrogen ($N_2$), etc.

Figure 6:
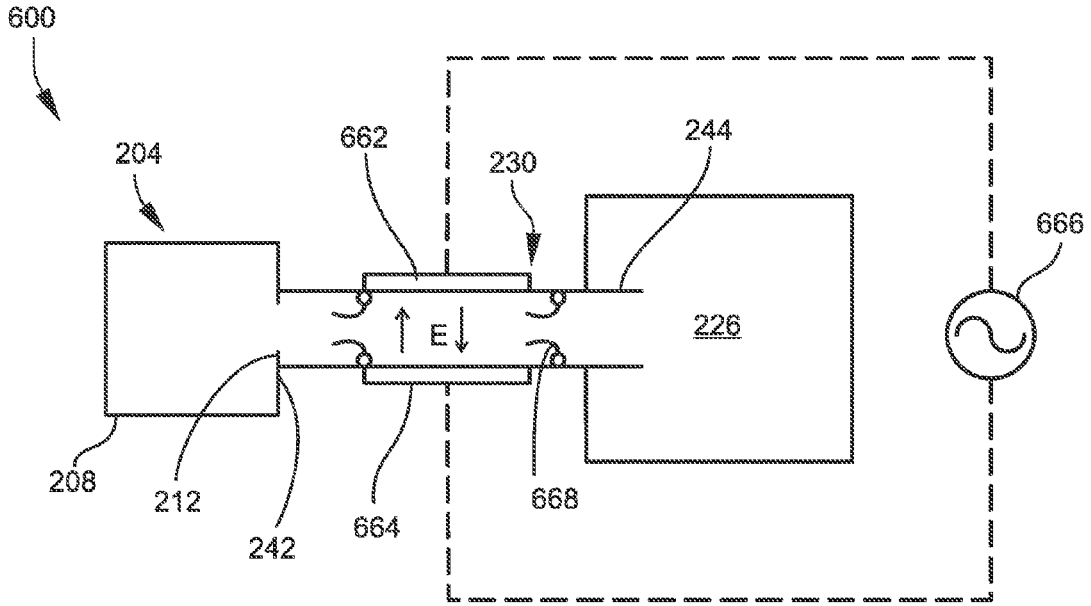
FIG. 6 is a schematic view of an example of a photon source according to an embodiment that applies an AC electric field to the interior of a photon guide.
Figure 7:
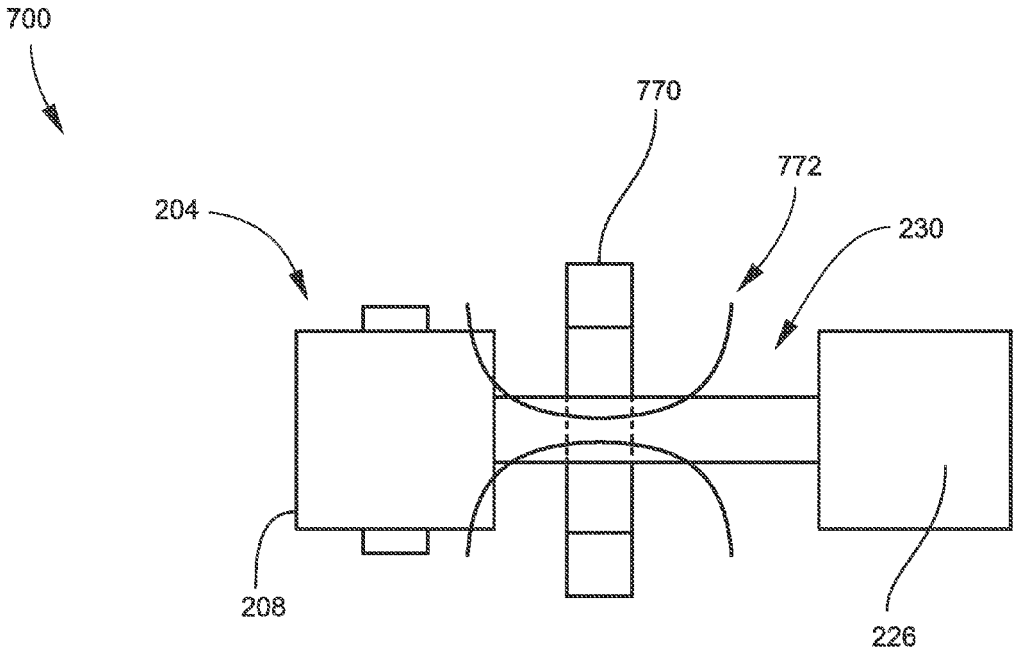
FIG. 7 is a schematic view of an example of a photon source according to an embodiment that includes one or more electromagnets.
Figure 8:
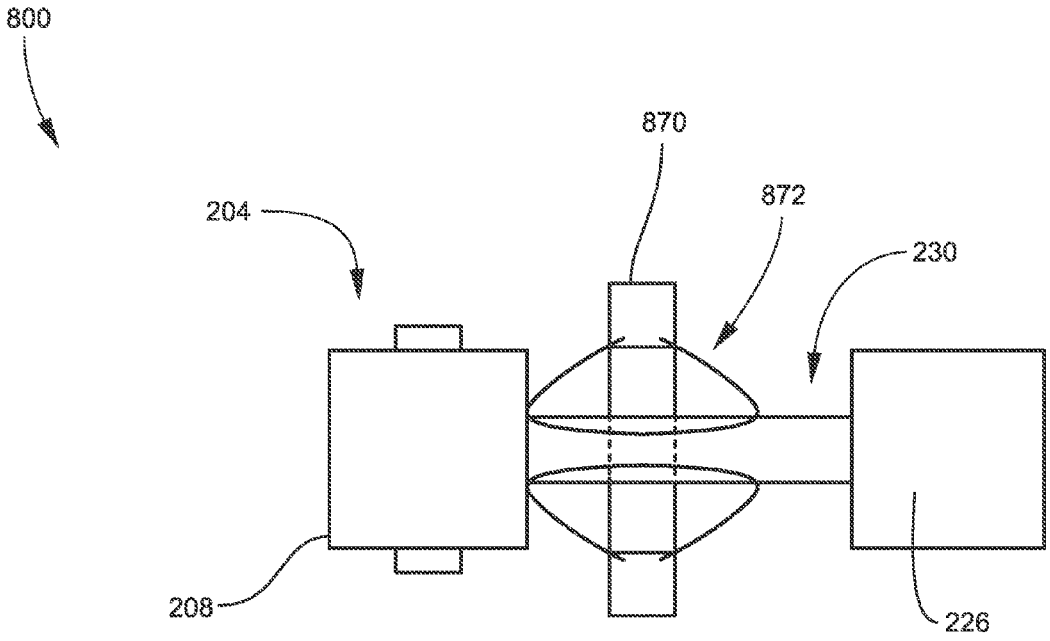
FIG. 8 is a schematic view of an example of a photon source according to an embodiment that includes one or more permanent magnets.

FIGS. 6-8 illustrate examples of embodiments in which process of reducing plasma density may be enhanced by immersing the interior of the photon guide in an electromagnetic, electrostatic, or magnetostatic field that attracts or deflects plasma ions and electrons toward the inner surface for recombination. In such embodiments, the photon source may thus include a device for applying the energetic field. The energetic field may be, for example, a static electric field (assuming the photon guide is not an insulating or dielectric material), a periodic electric field, a static magnetic field, a periodic magnetic field, or a combination of two of more of the foregoing.

FIG. 6 is a schematic view of an example of a photon source 600 according to an embodiment that applies an AC electric field E to the interior of the photon guide 230. A plurality of electrodes, for example two opposing electrodes 662 and 664, are positioned on the outer surface of the photon guide 230 and placed in signal communication with an AC voltage source 666. As schematically illustrated, application of an AC voltage to the electrodes 662 and 664 generates an AC electric field in the photon guide 230, thereby driving charged plasma particles 668 (ions and electrons) in alternating vertical trajectories onto the inner surface. Thus, application of the electric field enhances surface recombination and suppression of plasma flux flowing out from the photon guide 230. Photons are not sensitive to the electric field and thus propagate normally and in the manner described above.

In other embodiments, the photon guide 230 may be conductive and a static (DC) electric field may be applied. A single electrostatic potential may be applied to the entire photon guide 230. Alternatively, the photon guide 230 may include two or more conductive sections (e.g., two semicylinders) isolated from each other by insulating sections, in which case differential potentials may be applied to the conductive sections.

FIG. 7 is a schematic view of an example of a photon source 700 according to an embodiment that includes a magnet (or more than one magnet). In this embodiment, the magnet is an electromagnet 770 is positioned so as to surround the photon guide 230. The electromagnet 770 may be structured as a ring or a coil having one or more turns about the photon guide 230. The electromagnet 770 applies a diverging static magnetic field 772 to the interior of the photon guide 230 as schematically shown. For this purpose, the electromagnet 770 in practice is coupled to a suitable current source (not shown). FIG. 8 is a schematic view of another example of a photon source 800 according to an embodiment that includes a magnet (or more than one magnet). In this embodiment, the magnet is a permanent magnet 870 may be configured to be axially magnetized and may, for example, be structured as a ring surrounding the photon guide 230. The permanent magnet 870 applies a diverging static magnetic field 872 to the interior of the photon guide 230 as schematically shown.

In either case, the addition of a diverging magnetic field serves to enhance the diffusion of plasma toward the inner surface(s) of the photon guide 230 where the plasma is extinguished through recombination of plasma ions and electrons. In physical terms, the low mass electrons are forced to travel on spiral trajectories centered on magnetic field lines. Because these field lines intersect the wall(s) of the photon guide 230 as illustrated, the electrons are forced to impact the inner surface. Depending on the strength and geometrical arrangement of the magnetic field, some of the electrons will be reflected back down the field lines that they were guided along due to the magnetic mirror effect. These reflected electrons may either enhance plasma and photon production or eventually impact the inner surface and thus be removed from the interior of the photon guide 230. If the magnetic field is sufficiently strong, the ion trajectories will also be directly affected by the field, but such field magnitudes are not necessary. The heavier ions, which are less susceptible to direct deflection by the magnetic field, are nonetheless forced to follow the electrons due to their electrostatic attraction to the electrons (the so-called "ambipolar field"). In contrast to the plasma electrons and ions, as in the case of an electric field the trajectory of the photons is not altered by the magnetic field.

As noted earlier in this disclosure, there is a natural radial diffusion that causes the plasma to expand outward and recombine on the inner surface as it flows through the photon guide 230, even in the absence of a magnetic field (or an electric field). If, however, the magnetic field is strong enough and properly oriented it will lead to a much stronger radial flux of plasma onto the inner surface. This can allow for a shorter length of the photon guide 230, and therefore a higher net photon flux transmitted from the photon guide 230 and a more compact design. The magnetic enhancement of the radial diffusion should be significant when the mean free path of electrons between collisions with neutral molecules is long compared to the cyclotron radius. This will be the case, for example, in a photon guide 230 with a diameter and length of several mm, for neutral pressures equal to or less than approximately 1 Torr and magnetic flux densities of at least 1 kG. These conditions are readily achievable in embodiments disclosed herein. Collisions with neutral particles will lead to cross-field diffusion, which may diminish the enhancement by the magnetic field to some extent but will still contribute to the desired effect of plasma diffusing to the inner surface of the photon guide 230. By forcing the plasma to expand outward into the inner surface (where it recombines and decays) at a rate faster than free diffusion, the length of the photon guide 230 can be shortened as noted above while still producing the same reduction in plasma flux.

It will be noted that magnetic field arrangements other than those illustrated in FIGS. 7 and 8 may be implemented and may provide the same function, so long as the field lines pass through the wall of the photon guide 230. It will also be noted that other embodiments may be configured to apply both electric and magnetic fields to the photon guide 230. Such other embodiments may include a combination of features such as those described above with reference to FIGS. 6-8.

Figure 9:
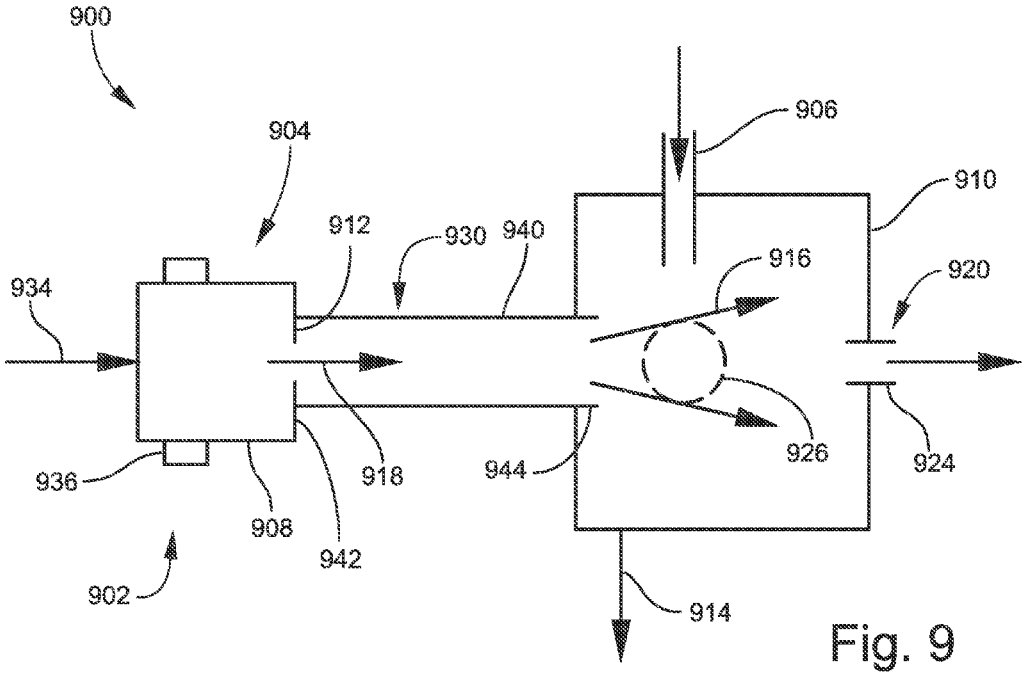
FIG. 9 is a schematic view of an example of a photo-ionization (PI) apparatus according to some embodiments.

FIG. 9 is a schematic view of an example of a photo-ionization (PI) apparatus (or ion source) 900 according to some embodiments. The PI apparatus 900 generally includes a photon source 902 and a sample conduit or inlet 906 positioned to direct a flow of sample material into the path of photons 916 generated by the photon source 902. In some embodiments, the photon source 902 is generally configured as described above in conjunction with FIG. 2. Thus, the photon source 902 includes a plasma source 904 and a photon guide 930. The plasma source 904 includes a housing 908 enclosing a plasma source interior, a gas inlet 934 for introducing a plasma-forming gas into the source interior, and an energy source 936 configured for generating the plasma from the plasma-forming gas. The housing 908 includes a plasma outlet 912 through which a plasma plume or cloud 918 is emitted from the source interior. The photon guide 930 includes one or more walls 940 enclosing a photon guide interior or volume between a guide inlet or inlet end 942 and a guide outlet or outlet end 944. The photon guide 930 includes an inner surface (of the wall or a layer thereon) that is internally reflective to the photons of the plasma as described above. The photon source 902 may further include other features such as described above in conjunction with one or more of FIGS. 2 and 5-8, such as a conduit (not shown) for directing a sweep gas to a gap (not shown) between the plasma source 904 and the photon guide 930, and/or a device (not shown) for applying a supplemental field to the photon guide 930.

In the present embodiment, the photon guide 930 and the sample conduit 906 communicate with a chamber 910 defined by a suitable housing. Accordingly, an ionization region 926 is established in the chamber 910, which may for example be an ionization chamber provided with a spectrometer or other ion measuring device. The chamber 910 may generally be considered as any enclosure or closed environment communicating with the plasma source 904 and in which ionization occurs. The chamber 910 may be pressure controlled and thus may include a port 914 communicating with a pumping system via an exhaust line (vacuum line). In some embodiments, the chamber 910 is held at a lower pressure than the plasma source 904 whereby gas flow through the photon guide 930 is driven primarily by the resulting pressure gradient. Depending on the embodiment, photo-ionization may be implemented at or around atmospheric pressure, or at sub-atmospheric pressure levels including very low-pressure or vacuum levels. The chamber 910 may also include an ion outlet 920 configured for transmitting analyte ions to a spectrometer or other type of ion detector or analytical instrument. The ion outlet 920 may be configured as an ion optics device, or may include or be operatively associated with ion optics elements 924. Some ion optics may be located in the chamber 910. Because little or no charged plasma particles enter the chamber 910 from the photon guide 930 as described above, there is minimal risk that the PI process will adversely affect the operation of such ion optics or cause arcing in the chamber 910.

Figure 10:
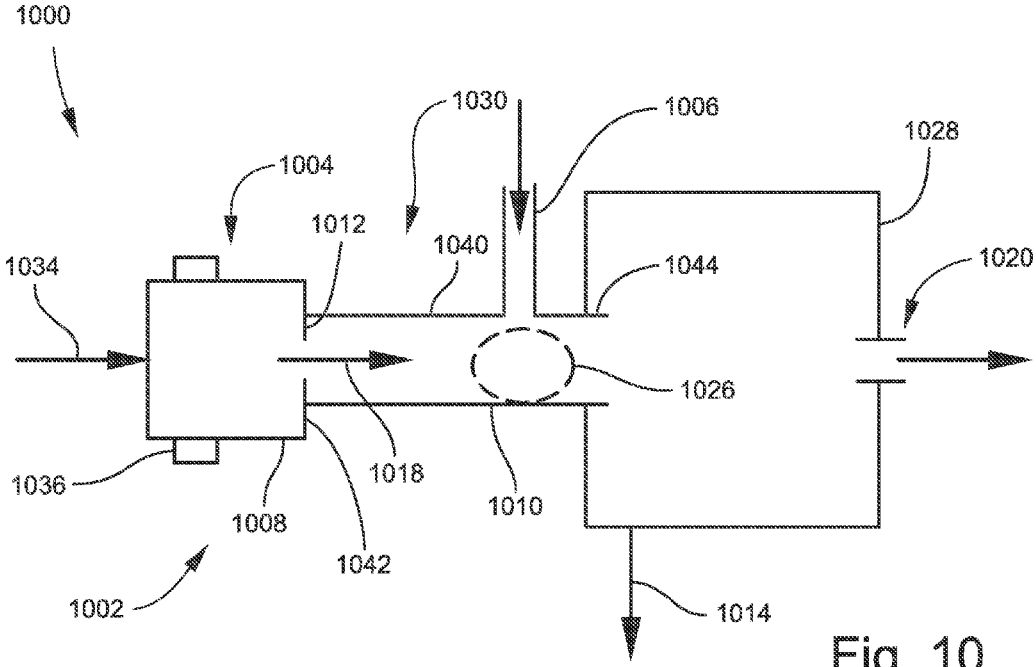
FIG. 10 is a schematic view of another example of a photo-ionization (PI) apparatus according to some embodiments.

FIG. 10 is a schematic view of another example of a photo-ionization (PI) apparatus (or ion source) 1000 according to some embodiments. The PI apparatus 1000 generally includes a photon source 1002 and a sample conduit or inlet 1006 positioned to direct a flow of sample material into the path of photons generated by the photon source 1002. The photon source 1002 may be generally configured as described above in conjunction with FIG. 9. Thus, the photon source 1002 includes a plasma source 1004 and a photon guide 1030. The plasma source 1004 includes a housing 1008 with a plasma outlet 1012, a gas inlet 1034, and an energy source 1036. The photon guide 1030 includes one or more walls 1040 between a guide inlet or inlet end 1042 and a guide outlet or outlet end 1044, and an inner surface internally reflective to plasma-generated photons. The photon source 1002 may further include other features described above.

In the embodiment illustrated in FIG. 10, the sample conduit 1006 communicates directly with the photon guide 1030. For example, the sample conduit 1006 may be coupled to, or pass through, an aperture in the wall 1040 of the photon guide 1030. The sample conduit 1006 may be axially positioned at a point along the length of the photon guide 1030 that is far enough away from the plasma outlet 1042 to ensure that the plasma flux has been adequately suppressed, such that the sample material flows into the photon flux and encounters little or no plasma flux. The sample conduit 1006 may be oriented at any angle relative to the photon guide axis, the illustrated ninety-degree orientation being but one example. In this embodiment, an ionization region 1026 is established in the interior of the photon guide 1030. Accordingly, this section of the photon guide 1030 may be considered as an ionizing section 1010 of the photon guide 1030, and may further be considered as the ionization chamber of the PI apparatus 1000. The ionizing section 1010 may be located at or proximal to the outlet end 1044 of the photon guide 1030. Alternatively, the length of the photon guide 1030 may be extended for some distance past the point of sample introduction as needed to optimize ionization efficiency. In either case, the outlet end 1044 in this embodiment emits analyte ions. The outlet end 1044 may be placed in communication with any detector or analytical instrument, either directly or via intervening ion optics or ion guide(s). Alternatively, the outlet end 1044 may communicate with a chamber 1028 of larger volume than the photon guide 1030. In some embodiments, this chamber 1028 may be considered as an additional part or extension of the ionizing section 1010 associated with the photon guide 1030. The chamber 1028 may be useful as a pressure-controlled interface between the photon source 1002 and a downstream detector or analytical instrument. Thus, the chamber 1028 may include an exhaust port 1014 and an ion outlet 1020.

Figure 11:
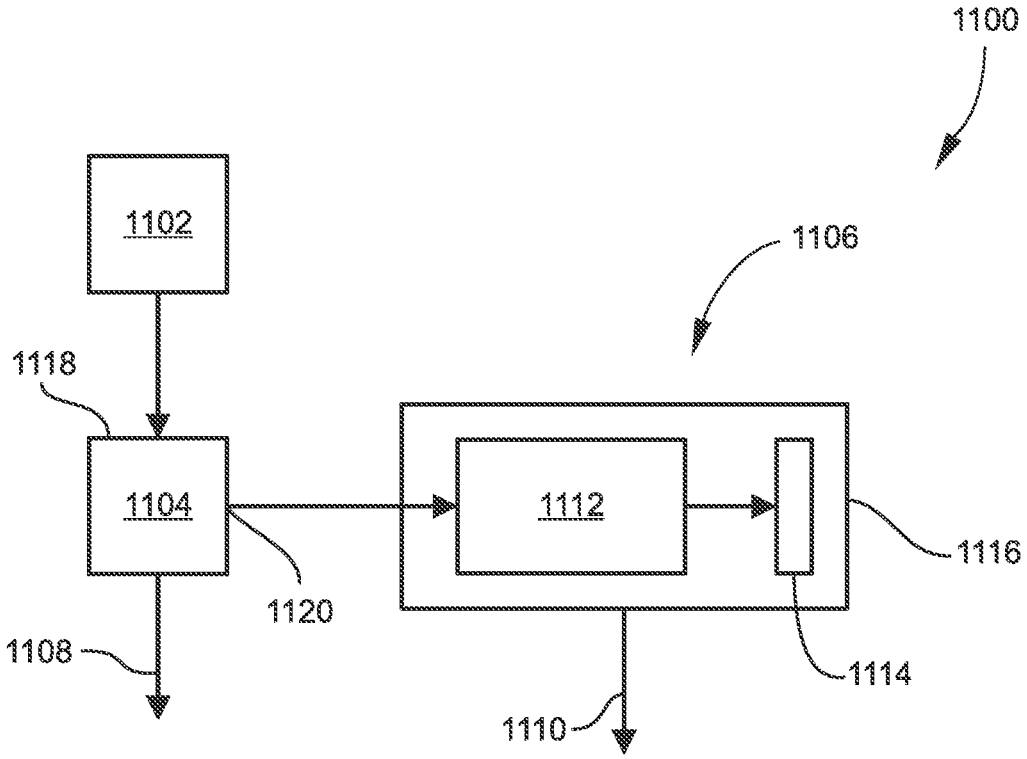
FIG. 11 is a schematic view of an example of a mass spectrometry (MS) system according to some embodiments.

FIG. 11 is a schematic view of an example of a mass spectrometry (MS) system 1100 according to one embodiment. The MS system 1100 generally includes a sample source 1102, an ionization apparatus (or ion source) 1104, a mass spectrometer (MS) 1106, and a vacuum system for maintaining the interior of the MS 1106 (and in some embodiments the interior of the ionization apparatus 1104) at controlled, sub-atmospheric pressure levels. The vacuum system is schematically depicted by vacuum lines 1108 and 1110 leading from the ionization apparatus 1104 and MS 1106, respectively. The vacuum lines 1108 and 1110 are schematically representative of one or more vacuum-generating pumps and associated plumbing and other components appreciated by persons skilled in the art. The structure and operation of various types of sample sources, MSs, and associated components are generally understood by persons skilled in the art, and thus will be described only briefly as necessary for understanding the presently disclosed subject matter. In practice, the ionization apparatus 1104 may be integrated with the MS 1106 or otherwise considered as the front end or inlet of the MS 1106, and thus in some embodiments may be considered as a component of the MS 1106.

The sample source 1102 may be any device or system for supplying a sample to be analyzed to the ionization apparatus 1104. The sample is typically provided in a gas-phase (or vapor) form that flows from the sample source 1102 into the ionization apparatus 1104. In hyphenated systems such as liquid chromatography-mass spectrometry (LC-MS) or gas chromatography-mass spectrometry (GC-MS) systems, the sample source 1102 may be an LC or GC system, in which case an analytical column of the LC or GC system is interfaced with the ionization apparatus 1104 through suitable hardware. The pressure in the sample source 1102 is typically around atmospheric pressure (around 760 Torr) or at a somewhat sub-atmospheric pressure.

Generally, the ionization apparatus 1104 is configured for producing analyte ions from a sample provided by the sample source 1102 and directing the as-produced ions into the MS 1106. The ionization apparatus 1104 may be a photo-ionization (PI) apparatus configured according to any of the embodiments disclosed herein. In some embodiments the ionization apparatus 1104 generates UV or VUV photons, although as indicated elsewhere in this disclosure the broad aspects of the subject matter taught herein are not limited to the UV or VUV spectrum. The internal pressure of the ionization apparatus 1104 may generally range from 0 to 1000 Torr. Thus, in some embodiments the ionization apparatus 1104 may be utilized for atmospheric pressure photo-ionization (APPI). In other embodiments, the internal pressure of the ionization apparatus 1104 is maintained by the vacuum system at an intermediate, sub-atmospheric pressure that is lower than the pressure of the sample source 1102 (or the ambient pressure outside the ionization apparatus 1104) but is higher than the vacuum pressure inside the MS 1106, particularly the mass analyzing region of the MS 1106. In some embodiments, the pressure of the ionization apparatus 1104 ranges from 0.01 to 100 Torr. In other embodiments, the pressure of the ionization apparatus 1104 ranges from 0.05 to 50 Torr. In other embodiments, the pressure of the ionization apparatus 1104 ranges from 0.1 to 10 Torr.

FIG. 11 schematically depicts the ionization apparatus 1104 as including a sample inlet 1118 for introducing a sample into the ionization apparatus 1104 and an ion outlet 1120 for transferring an ion beam into the MS 1106. The sample inlet 1118 may be a conduit for introducing a fluid (typically gas or vapor) sample. The ion outlet 1120 may be any component or combination of components configured for enabling the analyte ions to be transferred into the mass analyzer 1112 with minimal or no loss of ions, with minimal non-analytical components such as neutral species, and without breaking the vacuum of the MS 1106. The ion outlet 1120 may, for example, include one or more of the following, as appreciated by persons skilled in the art: capillary, orifice, ion optics, skimmer plate, ion guide, ion funnel, ion slicer, aperture, etc.

The MS 1106 may generally include a mass analyzer 1112 and an ion detector 1114 enclosed in a housing 1116. The vacuum line 1110 maintains the interior of the mass analyzer 1112 at very low (vacuum) pressure. In some embodiments, the mass analyzer 1112 pressure ranges from $10^{-4}$ to $10^{-9}$ Torr. The vacuum line 1110 may also remove any residual non-analytical neutral molecules from the MS 1106. The mass analyzer 1112 may be any device configured for separating, sorting or filtering analyte ions on the basis of their respective m/z ratios. Examples of mass analyzers include, but are not limited to, multipole electrode structures (e.g., quadrupole mass filters, ion traps, etc.), time-of-flight (TOF) analyzers, and ion cyclotron resonance (ICR) traps. The mass analyzer 1112 may include a system of more than one mass analyzer, particularly when ion fragmentation analysis is desired. As examples, the mass analyzer 1112 may be a tandem MS or $MS^n$ system, as appreciated by persons skilled in the art. As another example, the mass analyzer 1112 may include a mass filter followed by a collision cell, which in turn is followed by a mass filter (e.g., a triple-quad or QQQ system) or a TOF device (e.g., a qTOF system). In other embodiments another type of analytical separation instrument may be substituted for the MS 1106, such as an ion mobility spectrometer (IMS) in which case an IMS drift tube may be substituted for the mass analyzer 1112, or an IMS or other type of analytical separation instrument may operate in tandem with the MS 1106 to provide an additional dimension to the analysis. The ion detector 1114 may be any device configured for collecting and measuring the flux (or current) of mass-discriminated ions outputted from the mass analyzer 1112. Examples of ion detectors 1114 include, but are not limited to, electron multipliers, photomultipliers, and Faraday cups.

Figure 12:
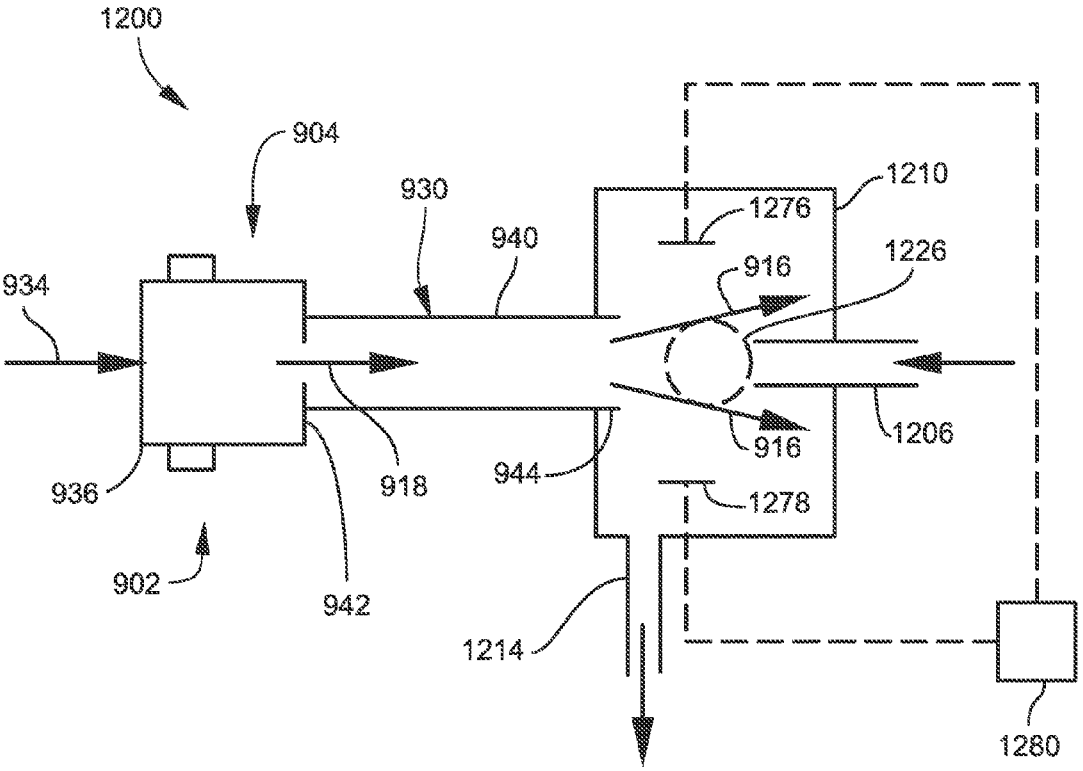
FIG. 12 is a schematic view of an example of a photo-ionization (PI) detector according to some embodiments.

FIG. 12 is a schematic view of an example of a photo-ionization (PI) detector 1200 according to some embodiments. The PI detector 1200 includes a photon source 902 that may be configured the same as or similar to any of the embodiments described herein. By example, the photon source 902 is depicted in FIG. 12 in the same manner as in FIG. 9. The PI detector 1200 includes a sample conduit or inlet 1206 for directing sample material into the path of photons 916 at an ionization region 1226. The sample conduit 1206 may supply the sample material from analytical separation instrument such as a GC. The photon guide 930 and the sample conduit 1206 communicate with a chamber 1210 defined by a suitable housing. The chamber 1210 may be pressure controlled and may include a port 1214 communicating with a pumping system via a gas exhaust line. A plurality of electrodes (e.g., two electrodes 1276 and 1278) is positioned in the chamber 1210 relative to the ionization region 1226 as needed to effectively collect ionization current. The electrodes 1276 and 1278 are in signal communication with current measuring electronics or circuitry 1280, which includes components (e.g., ammeter or electrometer, amplifiers, etc.) as needed for amplifying, conditioning and otherwise processing the ion current signal, providing a readout or display of measurement data, etc., as appreciated by persons skilled in the art. Because little or no charged plasma particles enter the chamber 1210 from the photon guide 930 as described above, there is minimal risk that the PI process will adversely affect the operation of the electrodes 1276 and 1278 or cause arcing in the chamber 1210.

Various embodiments have been described above primarily in the context of photo-ionization, which typically utilizes UV or VUV photons. It will be understood, however, that the subject matter disclosed herein is not limited to applications involving photo-ionization or to applications entailing the use of UV or VUV emission. Embodiments disclosed herein may be utilized in any application requiring a source of UV, visible, or IR photons. In addition to MS and IMS instruments, other analytical instruments may utilize photons to perform a variety of optical-based measurements on a sample (e.g., an optical property such as absorbance, reflectance, transmittance, luminescence, light scattering, fluorescence, phosphorescence, etc.). In such cases, the sample may be provided in a sample holder (e.g., a sample cell, flow cell, multi-well plate, or the like) and irradiated by the plasma-produced photons to produce a response that does not involve ionization (i.e., non-ionizing irradiation). Examples of such other analytical instruments include, but are not limited to, spectrophotometers, other instruments of spectroscopy/spectrophotometry, and optical plate readers. Such instruments typically include a photon source, optics elements (e.g., monochromator, polychromator, optical filter, light guide, etc.), a sample holder through which the source light is transmitted, and detection and signal processing hardware. The design and operation of such instruments are generally understood by persons skilled in the art. To irradiate the sample the photon source may be brought into proximity with the sample, or may be coupled to optics elements (e.g., lenses, optical fibers, light pipes, minors, prisms, gratings, photonic crystals, etc.) that efficiently route the photons to the sample.

Moreover, the use of embodiments disclosed herein is not limited to analytical instrumentation. For example, photons may be generated for use by optical sensors. As other examples, UV radiation may be utilized in photolithography, or to cure or cross-link certain polymers, sterilize food, sterilize or disinfect liquids or solid surfaces, perform other types of surface treatments, purify air, or detoxify or kill microorganisms. IR radiation may, for example, be utilized for radiative heating or curing, or for measurement of surface temperature. Embodiments disclosed herein may generally be utilized in various applications as an alternative to conventional light sources such as arc lamps, flash lamps, light emitting diodes (LEDs), laser diodes (LDs), and lasers.

Exemplary Embodiments

Exemplary embodiments provided in accordance with the presently disclosed subject matter include, but are not limited to, the following:

1. A photon source, comprising: a plasma source comprising a housing enclosing a source interior and a plasma outlet communicating with the source interior; and a photon guide comprising an inlet end communicating with the plasma outlet for receiving plasma including photons generated thereby, an outlet end, and a wall having a length along a guide axis and enclosing a guide interior, wherein the wall comprises an inner surface configured for reflecting the photons.

2. The photon source of embodiment 1, wherein the plasma outlet has an inside diameter less than an inside diameter of the wall.

3. The photon source of embodiment 1 or 2, wherein the inlet end abuts the housing such that the inlet end forms a closed boundary around the plasma outlet.

4. The photon source of embodiment 1 or 2, wherein the inlet end is spaced from the plasma outlet by a gap.

5. The photon source of embodiment 4, comprising a gas conduit positioned to direct a flow of gas through the gap at an angle to the guide axis.

6. The photon source of any of embodiments 1-5, wherein the inner surface is configured for reflecting UV photons, visible photons, or IR photons.

7. The photon source of any of embodiments 1-6, wherein the inner surface is configured for reflecting photons by total internal reflection, mirror reflection, or both.

8. The photon source of any of embodiments 1-7, comprising a device selected from the group consisting of: a plurality of electrodes configured for applying a static or periodic electric field; a magnet configured for applying a static or periodic magnetic field; and both of the foregoing.

9. The photon source of any of embodiments 1-7, comprising a plurality of electrodes configured for applying a DC electric field, wherein the wall comprises a plurality of conductive sections communicating with the respective electrodes.

10. The photon source of any of embodiments 1-9, comprising a chamber communicating with the outlet end, and a pressure control system configured for creating a pressure differential between the source interior and the chamber.

11. A photo-ionization (PI) apparatus, comprising: the photon source of embodiment 1; and a sample conduit positioned to direct a flow of sample material into a path of the photons.

12. The PI apparatus of embodiment 11, comprising a chamber communicating with the outlet end.

13. The PI apparatus of embodiment 12, wherein the sample conduit is positioned to direct the flow of sample material into the chamber.

14. The PI apparatus of embodiment 11 or 12, wherein the sample conduit is positioned to direct the flow of sample material into the photon guide.

15. An analytical system, comprising: the PI apparatus of embodiment 11; and an analytical instrument communicating with the outlet end.

16. The analytical system of embodiment 15, comprising a chamber communicating with the outlet end, wherein the chamber comprises an ion exit communicating the analytical instrument.

17. The analytical system of embodiment 15 or 16, wherein the analytical instrument is selected from the group consisting of a mass spectrometer, an ion mobility spectrometer, a spectrophotometer, and a photo-ionization detector.

18. A method for supplying photons, the method comprising: generating plasma in a plasma source; and forming a reduced-density plasma by flowing the plasma from the plasma source through a hollow photon guide comprising an inner surface configured for reflecting photons of the plasma, wherein ions and electrons of the plasma recombine at the inner surface while the photons are reflected from the inner surface; and directing the photons of the reduced-density plasma toward an outlet end of the photon guide.

19. The method of embodiment 18, comprising flowing the plasma into the photon guide via a plasma outlet of the plasma source, wherein the plasma outlet has an inside diameter smaller than an inside diameter of the photon guide.

20. The method of embodiment 18 or 19, comprising flowing the plasma from a plasma outlet of the plasma source and across a gap between the plasma outlet and an inlet end of the photon guide.

21. The method of embodiment 20, comprising flowing a sweep gas through the gap at an angle to a direction of flow of the plasma to divert neutral gas molecules and plasma species away from the inlet end.

22. The method of any of embodiments 18-21, wherein the plasma generated emits UV photons, visible photons, or IR photons.

23. The method of any of embodiments 18-22, wherein generating the plasma comprises energizing a gas selected from the group consisting of a noble gas, a combination of two or more noble gases, and a combination of a non-noble gas and one or more noble gases.

24. The method of any of embodiments 18-23, wherein as the plasma flows through the photon guide, the photons are reflected by total internal reflection, mirror reflection, or both.

25. The method of any of embodiments 18-24, comprising, while flowing the plasma through the photon guide, attracting ions and electrons of the plasma toward the inner surface.

26. The method of embodiment 25, wherein attracting is selected from the group consisting of: applying an electric field to an interior of the photon guide; applying a magnetic field to an interior of the photon guide; and both of the foregoing.

27. The method of any of embodiments 18-26, comprising directing the photons from the outlet end into a chamber.

28. The method of embodiment 27, comprising maintaining the chamber at a lower pressure than the plasma source.

29. A method for ionizing a sample, the method comprising: supplying photons according to the method of embodiment 18 to an ionization region; and introducing the sample into the ionization region.

30. The method of embodiment 29, comprising, prior to introducing the sample, subjecting the sample to analytical separation.

31. The method of embodiment 29 or 30, comprising introducing the sample into the photon guide, wherein analyte ions formed by ionizing exit the outlet end.

32. A method for analyzing a sample, the method comprising: ionizing the sample according to the method of embodiment 29 to form analyte ions; and measuring an attribute of the analyte ions.

33. The method of embodiment 32, wherein measuring is selected from the group consisting of: measuring abundances of the analyte ions based on mass-to-charge ratios; measuring abundances of the analyte ions based on collision cross-sections; measuring ionization current; and two or more of the foregoing.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A photo-ionization (PI) apparatus, comprising:

a plasma source comprising a housing enclosing a source interior and a plasma outlet communicating with the source interior;

a photon guide comprising an inlet end communicating with the plasma outlet for receiving plasma including photons generated thereby, an outlet end, and a wall having a length along a guide axis and enclosing a guide interior, wherein the wall comprises an inner surface configured for reflecting the photons while suppressing plasma flux;

and a sample conduit positioned to direct a flow of sample material into a path of the photons: wherein the sample conduit is located downstream of the plasma source.

2. The PI apparatus of claim 1, wherein the plasma outlet has an inside diameter less than an inside diameter of the wall.

3. The PI apparatus of claim 1, wherein the inlet end abuts the housing such that the inlet end forms a closed boundary around the plasma outlet.

4. The PI apparatus of claim 1, wherein the inlet end is spaced from the plasma outlet by a gap.

5. The PI apparatus of claim 4, comprising a gas conduit positioned to direct a flow of gas through the gap at an angle to the guide axis.

6. The PI apparatus of claim 1, wherein the inner surface is configured for reflecting UV photons, visible photons, or IR photons.

7. The PI apparatus of claim 1, wherein the inner surface is configured for reflecting photons by total internal reflection, minor reflection, or both.

8. The PI apparatus of claim 1, comprising a device selected from the group consisting of: a plurality of electrodes configured for applying a static or periodic electric field; a magnet configured for applying a static or periodic magnetic field; and both of the foregoing.

9. The PI apparatus of claim 1, comprising a plurality of electrodes configured for applying a DC electric field, wherein the wall comprises a plurality of conductive sections communicating with the respective electrodes.

10. The PI apparatus of claim 1, comprising a chamber communicating with the outlet end, and a pressure control system configured for creating a pressure differential between the source interior and the chamber.

11. A method for ionizing a sample, the method comprising:

generating plasma in a plasma source;

forming a reduced-density plasma by flowing the plasma from the plasma source through a hollow photon guide comprising an inner surface configured for reflecting photons of the plasma while suppressing plasma flux, wherein ions and electrons of the plasma recombine at the inner surface while the photons are reflected from the inner surface;

directing the photons of the reduced-density plasma toward an outlet end of the photon guide and into an ionization region located downstream of the plasma source; and introducing the sample into the ionization region.

12. The method of claim 11, comprising flowing the plasma from a plasma outlet of the plasma source and across a gap between the plasma outlet and an inlet end of the photon guide.

13. The method of claim 12, comprising flowing a sweep gas through the gap at an angle to a direction of flow of the plasma to divert neutral gas molecules and plasma species away from the inlet end.

14. The method of claim 11, wherein the plasma generated emits UV photons, visible photons, or IR photons.

15. The method of claim 11, wherein generating the plasma comprises energizing a gas selected from the group consisting of a noble gas, a combination of two or more noble gases, and a combination of a non-noble gas and one or more noble gases.

16. The method of claim 11, wherein as the plasma flows through the photon guide, the photons are reflected by total internal reflection, mirror reflection, or both.

17. The method of claim 11, comprising, while flowing the plasma through the photon guide, attracting ions and electrons of the plasma toward the inner surface.

18. The method of claim 17, wherein attracting is selected from the group consisting of: applying an electric field to an interior of the photon guide; applying a magnetic field to an interior of the photon guide; and both of the foregoing.

* * * * *

UNITED STATES PATENT AND TRADEMARK OFFICE

CERTIFICATE OF CORRECTION

PATENT NO. : 9,029,797 B2
APPLICATION NO. : 13/951301
DATED : May 12, 2015
INVENTOR(S) : Denning et al.

It is certified that error appears in the above-identified patent and that said Letters Patent is hereby corrected as shown below:

In the specification

Column 15, line 12, delete “minors,” and insert -- mirrors, --, therefor.

In the claims

Column 18, line 2, claim 1, delete “photons:” and insert -- photons, --, therefor.

Column 18, line 20, claim 7, delete “minor” and insert -- mirror --, therefor.

Signed and Sealed this
Twenty-fourth Day of May, 2016

Michelle K. Lee

Michelle K. Lee
*Director of the United States Patent and Trademark Office*